US005992687A

United States Patent [19]

Hinds et al.

[11] Patent Number: 5,992,687

[45] Date of Patent: Nov. 30, 1999

[54] METHOD AND APPARATUS FOR DISPENSING PORTIONED FOOD PRODUCT

[75] Inventors: James R. Hinds, Redmond; Paul M. Henry, Seattle, both of Wash.

[73] Assignee: Hinds-Bock Corporation, Redmond, Wash.

[21] Appl. No.: 09/056,560

[22] Filed: Apr. 7, 1998

Related U.S. Application Data

[60] Provisional application No. 60/042,972, Apr. 8, 1997.

[51] Int. Cl.[6] ..... B65D 5/72; B22D 37/00; B67D 3/00; B67D 1/08

[52] U.S. Cl. ..... 222/1; 222/149; 222/504; 222/509; 222/571

[58] Field of Search ..... 222/1, 149, 504, 222/509, 571

[56] References Cited

U.S. PATENT DOCUMENTS

| | | | |
|---|---|---|---|
| 2,978,149 | 4/1961 | Rosen | 222/318 |
| 4,341,329 | 7/1982 | Kuemmerer et al. | 222/275 |
| 4,363,429 | 12/1982 | Schindler | 222/504 |
| 4,767,031 | 8/1988 | Proepper | 222/255 |
| 4,967,931 | 11/1990 | DeVries | 222/1 |
| 5,447,254 | 9/1995 | Hoover et al. | 222/1 |

OTHER PUBLICATIONS

Internet advertisement for Raque Food Systems, Inc., © 1998.

*Primary Examiner*—Andres Kashnikow
*Assistant Examiner*—Keats Quinalty
*Attorney, Agent, or Firm*—Graybeal Jackson Haley LLP

[57] ABSTRACT

Methods and apparatus for dispensing controlled portions of food products having high levels of tack. An apparatus for dispensing portions of food has a portioning chamber including a first end defining a ram mating orifice, a second end defining an expulsion orifice, and a body portion defining an inlet orifice intermediate the two ends for introducing bulk food product into the chamber. Disposed in the chamber is a piston having a face sized to substantially slidingly fit therein. An actuatable ram is located at the first end and coupled to the piston for causing controlled movement of the piston. The actuator is operated by a controller wherein the controller first causes the ram, by way of the actuator, to fully extend, then causes the ram to partially retract so that the face of the piston retracts no further than the inlet orifice, and then causes the ram to again fully extend. A method utilizes a portioning chamber that includes a first end defining a ram mating orifice, a second end defining an expulsion orifice, and a body portion defining an inlet orifice intermediate the two ends for introducing bulk food product into the chamber, as well as a piston having a face.-disposed in the chamber. The method comprises the steps of a) introducing a predetermined amount of food product into the chamber via the inlet orifice when the apparatus is in the nominal state; b) extending the piston face beyond the expulsion orifice; c) partially retracting the piston face so that it is within the chamber; d) extending the piston substantially as far as in step b); e) and returning the piston to its position in step a). In both the apparatus and method, compressed air can be presented to a foramenous piston face to facilitate dislodgment of food product.

9 Claims, 3 Drawing Sheets

METHOD AND APPARATUS FOR DISPENSING PORTIONED FOOD PRODUCT

This application claims benefit of Provisional Application Ser. No. 60/042,972 filed Apr. 18, 1997.

FIELD OF THE INVENTION

The present invention pertains to apparatus and methods for dispensing controlled proportions of food products, and particular food products having a high level of tack.

BACKGROUND OF THE INVENTION

It is well known in the industry to use positive cutoff spouts or portioning devices to meter the amount of bulk food that is to be deposited into a container. In such a device, a pneumatically controlled ram combination or other reciprocating assembly is coupled to a plug piston located in a cylindrical tube having a food product inlet orifice positioned generally intermediate the stroke of the plug piston. The piston has a skirt to prevent the entry of food product into the tube when the piston face descends past the inlet orifice.

In operation, a control signal is sent to an actuator and causes the ram, and therefore the plug piston, to fully retract, thereby permitting food product to enter the portioning cylinder via the inlet orifice. At a specific time interval, another control signal is sent to the actuator and causes the plug piston to fully extend, thus ejecting the food product from the portioning cylinder and into whatever container was located below it. This cycle would be repeated until a desired end was reached.

This area of the art, however, was not without problems. Because some food products had high levels of tack, they would often times stick to the piston face and thereby not provide precisely metered or portioned food product. A solution to this problem involved using a hollow ram rod to connect the air cylinder with the plug piston and creating a foramenous piston face. In this manner, at the point of full piston extension, a short blast of compressed air would be introduced into the hollow ram rod which would exit from the foramenous piston face and dislodge the stuck food product. This pneumatic dislodgment assistance was often time used in conjunction with a short and very small stroke reciprocation prior to the return of the piston to its initial position. This physical dislodgment assistance also proved to be effective in overcoming the identified problem.

Even in view of these advances, however, dispensing problems associated with certain food products having high levels of tack or sinuous materials such as found in meat products persisted. In particular, sinuous materials would often lodge in the annular space between the piston circumference and skirt, and the portioning cylinder wall. This lodgment would cause partial blocking of the inlet orifice, or additional sticking of food product during the dispensing step.

In view of the foregoing, the need for an improvement in this area of technology is apparent. The present invention is intended to meet this need.

SUMMARY OF THE INVENTION

The present invention relates to an improved method for dislodging food product from a conventional portioning machine comprising a chamber having at a first end a reciprocating ram assembly coupled to a piston sized to slidingly fit within the chamber, at a second end an expulsion orifice, and an inlet orifice intermediate the first and second ends wherein the piston has a face and is positionable at a location that permits complete exposure of the inlet orifice when the machine is in a nominal state. The improved method comprises the steps of a) introducing a predetermined amount of food product into the chamber via the inlet orifice when the machine is in the nominal state; b) extending the piston face beyond the expulsion orifice; c) partially retracting the piston face so that it is within the chamber; d) extending the piston substantially as far as in step b); and e) returning the piston to its position in step a). In certain applications, it may be desirable to retract the piston in step c) close to the inlet orifice so that maximum velocity of the piston may again be achieved to facilitate product dislodgment when the piston is again extended. Furthermore, prior art methods such as causing a pneumatic dislodgment at the piston face may also be practiced during step b), step d), or both steps b) and d).

An apparatus for carrying out the method aspect of the invention comprises a portioning chamber having a first end defining a ram mating orifice, a second end defining an expulsion orifice, and a body portion defining an inlet orifice intermediate the two ends for introducing bulk food product into the chamber; a piston having a face sized to substantially slidingly fit within the proportioning chamber; an actuatable ram located at the first end and coupled to the piston for causing controlled movement of the piston; and a controller for actuating controlled movement of the piston wherein the controller first causes the ram to fully extend, then causes the ram to partially retract so that the face of the piston retracts no further than the inlet orifice, and then causes the ram to again fully extend.

DETAILED DESCRIPTION OF THE INVENTION

Figure 1:
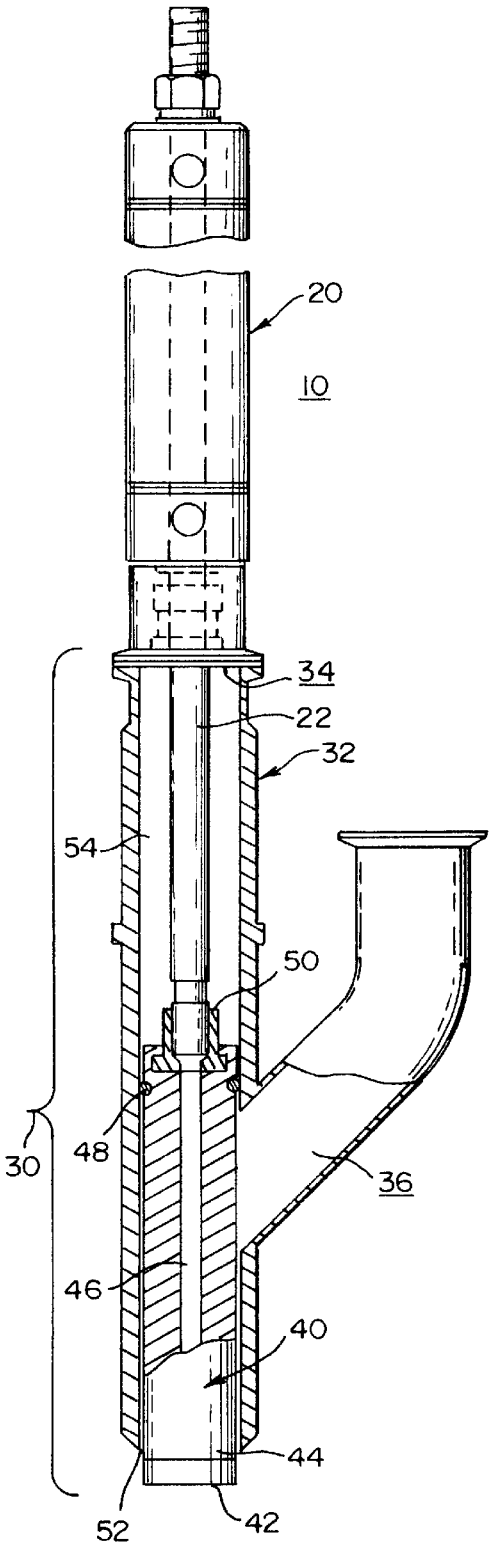
FIG. 1 is a partial cross sectional view of the apparatus showing a pneumatic ram linked to a plug piston of a portioning cylinder when the apparatus is in a nonactive state.

Reference is now made to the several drawings wherein like numerals indicate like parts, and more particularly to FIG. 1 wherein a partial cross sectional view shows the relative positions of the parts of portioning apparatus 10 in a pre-activation state. As shown, the basic apparatus 10 includes stroke controllable pneumatic ram 20, and spout assembly 30. Ram 20 is characterized as having hollow piston shaft 22 through which fluid, such as air, may be passed. Spout assembly 30 has two major components namely portioning cylinder 32 and plug piston 40. Portioning cylinder 32 has ram mating orifice 34, product inlet orifice 36, and product ejection orifice 38 and generally defines bore wall 49. Plug piston 40 has for exterior surfaces formenous piston face 42 and skirt 44. Plug piston 40 also defines interior bore 46 to permit the passage of fluid such as air from the upper portion of piston 40 to piston face 42. Naturally, the exterior diameter of piston 40 is marginally less than the internal diameter of portioning cylinder 32, however, annular gap 52 is present. Ring seal 48 helps to ensure a fluid impervious fit between piston 40 and wall 49 and prevent contamination into or from space 54. Lastly, coupler 50 provides the necessary mechanical linkage between hollow piston shaft 22 and plug piston 40.

Operation of the assembly is carried out by a remotely located programmable logic controller (PLC) which sends appropriate electrical signals to pneumatic ram 20, thereby causing the same to reciprocate as described immediately below.

Operation of the Invention

As described previously, a problem in the field of food product dispensing is that a given amount of portioned food product may not always be wholly deposited into the product receptacle due to undesired retention of the product in the portioning device. This problem is particularly acute when portioning high tack or sinuous materials. These materials often reside in annular gap 52 and may interfere with the deposition of product from inlet orifice 36 into bore 46 when also adhered to bore wall 49, thus creating a web that partially blocks orifice 36. The present invention overcomes this problem by carrying out an exaggerated reciprocation that will now be described.

Figure 2:
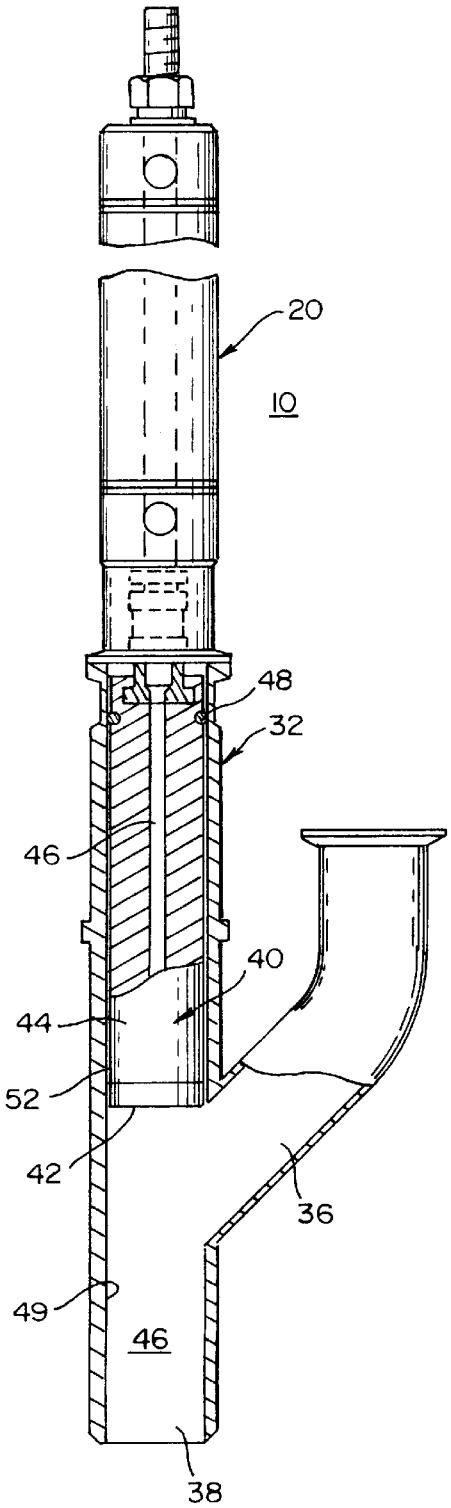
FIG. 2 is a partial cross sectional view of the apparatus showing the relative position of the plug piston when food product is being introduced into the portioning cylinder during a nominal state.
Figure 3:
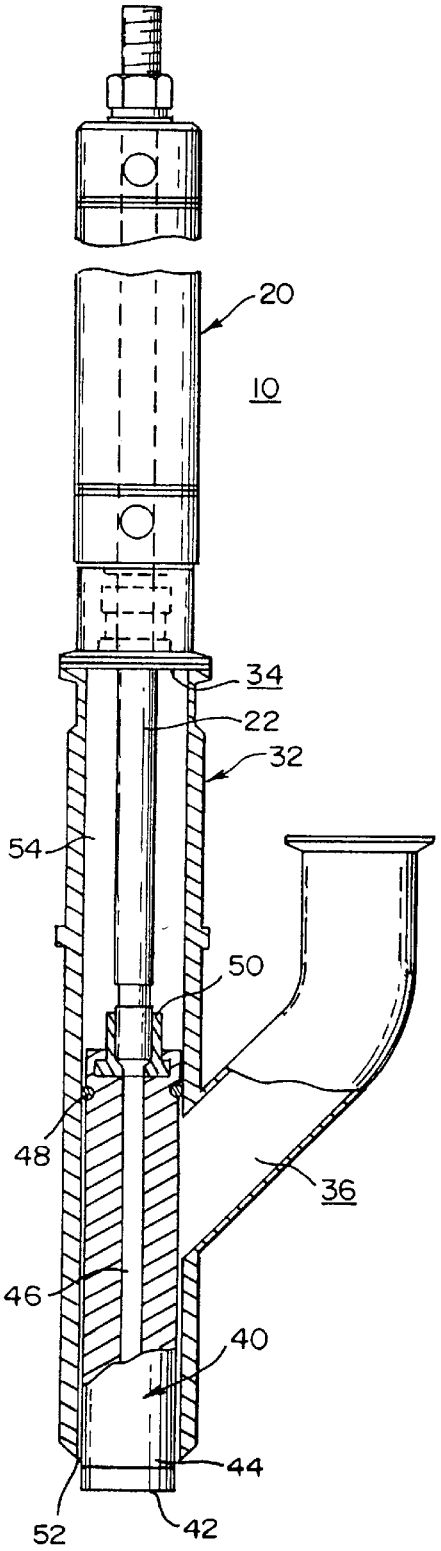
FIG. 3 is a partial cross sectional view of the apparatus showing the relative position of the plug piston when dispensing food product.

As is conventionally performed, the process begins with the apparatus in its initial state as is shown in FIG. 1. When it is desired to begin portioned dispensing, plug piston 40 is caused to retract by the retraction of shaft 22 of pneumatic ram 20 when an appropriate signal from a PLC (not shown) is received. As is shown in FIG. 2, piston 40 is retracted so that piston face 42 is above inlet orifice 36, thus permitting food product to be introduced into bore 46. During this nominal state, a desired amount of food product is thereby introduced, and ram 20 is activated so as to cause a full extension of plug piston 40 as is shown in FIG. 3.

Figure 4:
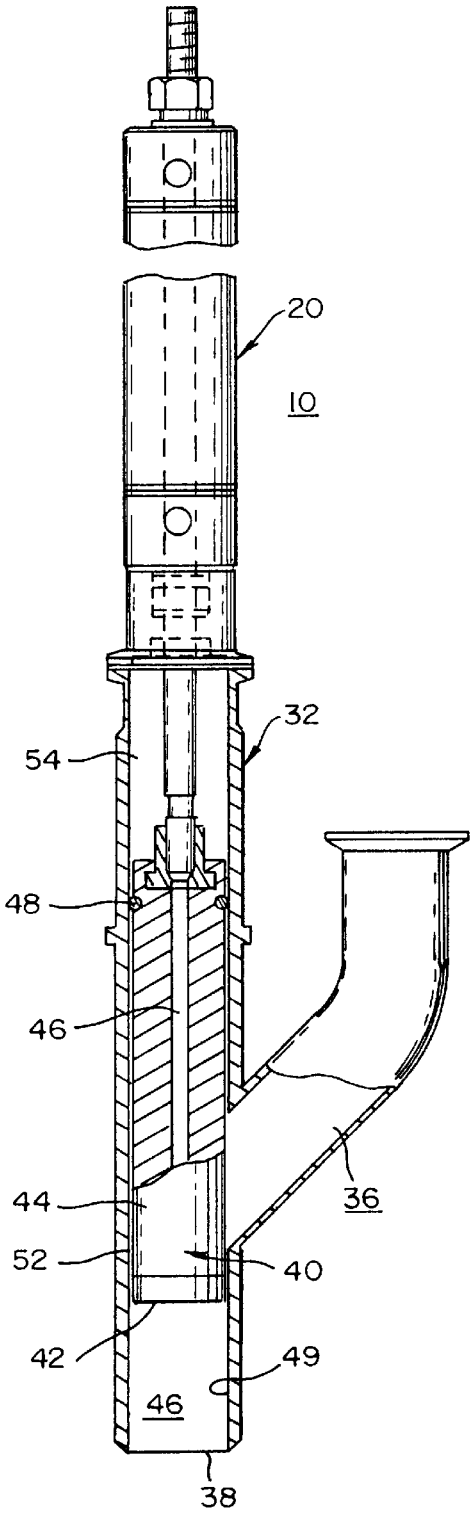
FIG. 4 is a partial cross sectional view of the apparatus showing the relative position of the plug piston when reaching the maximum retraction during the dislodgment cycle.
Figure 5:
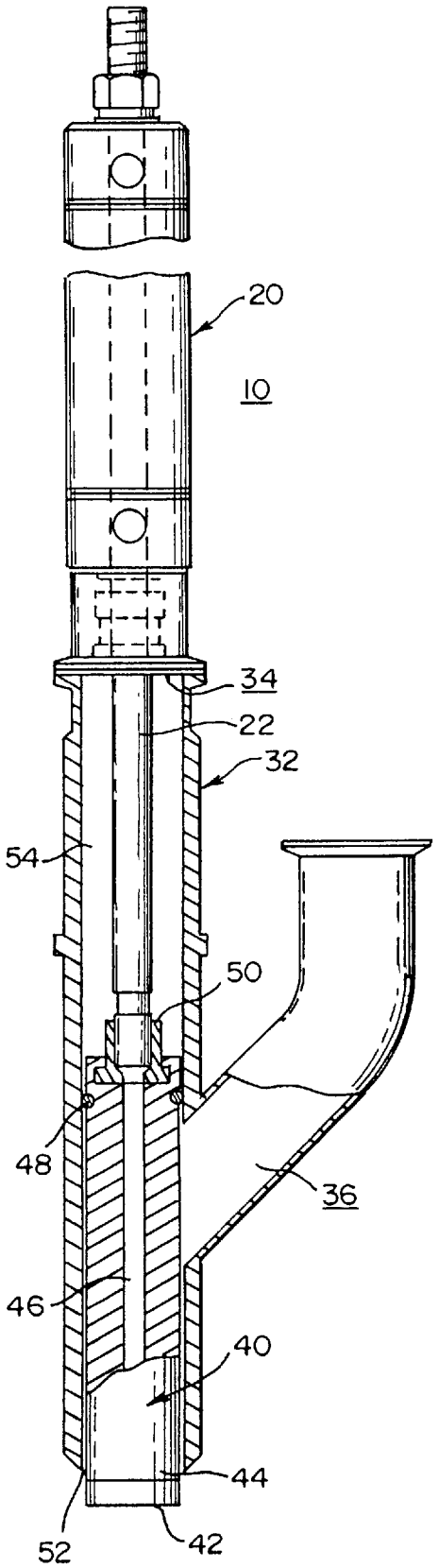
FIG. 5 is a partial cross sectional view of the apparatus showing the relative position of the plug piston when reaching the maximum extension during the dislodgment cycle.

Immediately following this full extension, plug piston 40 is caused to partially retract as shown in FIG. 4. To maximize the dislodging effect of the invention, piston 40 retracts nearly as far as it can without exposing any portion of inlet orifice 36. In other words, skirt 44 at all times blocks the introduction of product via inlet orifice 46, but face 42 is caused to move a maximum distance away from ejection orifice 38. Thus, when piston 40 again extends, the maximum velocity possible is reached prior to it decelerating to a momentarily stopped position at which time a short burst of air is delivered to piston face 42 via hollow shaft 22 and bore 46.

In addition to the foregoing, by implementing this exaggerated reciprocation, high tack material that may be adhered to piston face 42 and bore wall 49, or reside in annular gap 52 defined by skirt 44 and bore wall 49 and also adhered to bore wall 49 is caused to significantly stretch, thereby assisting in the dislodgment process and avoiding creation of a blocking web at orifice 36.

What is claimed:

1. An improved method for dislodging food product from a conventional portioning machine comprising a chamber having at a first end a reciprocating ram assembly coupled to a piston sized to slidingly fit within the chamber, at a second end an expulsion orifice, and an inlet orifice intermediate the first and second ends wherein the piston has a face and is positionable at a location that permits complete exposure of the inlet orifice when the machine is in a nominal state, the improved method comprising the steps of:

a) introducing a predetermined amount of food product into the chamber via the inlet orifice when the machine is in the nominal state;

b) extending the piston face beyond the expulsion orifice;

c) partially retracting the piston face so that it is within the chamber;

d) extending the piston substantially as far as in step b); and e) returning the piston to its position in step a).

2. The method of claim 1 wherein in step c) the piston face is brought to a position that is closer to the inlet orifice than the expulsion orifice.

3. The method of claim 1 wherein the piston face is comprised of a foramenous surface and a short blast of compressed gas is introduced thereat in step b).

4. The method of claim 1 wherein the piston face is comprised of a foramenous surface and a short blast of compressed gas is introduced thereat in step d).

5. The method of claim 4 wherein a short blast of compressed gas is introduced thereat in step b).

6. The method of claim 2 wherein wherein the piston face is comprised of a foraminous surface and a short blast of compressed gas is introduced thereat in steps b) and d).

7. An apparatus-for dispensing portioned food product comprising:

a portioning chamber having a first end defining a ram mating orifice, a second end defining an expulsion orifice, and a body portion defining an inlet orifice intermediate the two ends for introducing bulk food product into the chamber;

a piston having a face sized to substantially slidingly fit within the proportioning chamber;

an actuatable ram located at the first end and coupled to the piston for causing controlled movement of the piston; and a controller for actuating controlled movement of the piston wherein the controller first causes the ram to fully extend, then causes the ram to partially retract so that t face of the piston retracts no further than the inlet orifice, and then causes the ram to again fully extend.

8. The apparatus of claim 7 wherein the controller is programmed to cause the piston face to be brought to a position that is closer to the inlet orifice than the expulsion orifice.

9. The apparatus of claim 7 wherein the piston face is comprised of a foramenous surface.

* * * * *